US007273093B2

(12) United States Patent
Dürr et al.

(10) Patent No.: US 7,273,093 B2
(45) Date of Patent: Sep. 25, 2007

(54) HEAT EXCHANGER IN PARTICULAR AN EVAPORATOR FOR A VEHICLE AIR-CONDITIONING UNIT

(75) Inventors: Gottfried Dürr, Stuttgart (DE); Klaus Förster, Korntal-Münchingen (DE); Franz Ott, Stuttgart (DE); Wolfgang Seewald, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 47 days.

(21) Appl. No.: 10/518,613

(22) PCT Filed: Jul. 4, 2003

(86) PCT No.: PCT/EP03/07195

§ 371 (c)(1),
(2), (4) Date: Jul. 21, 2005

(87) PCT Pub. No.: WO2004/005827

PCT Pub. Date: Jan. 15, 2004

(65) Prior Publication Data

US 2006/0037740 A1 Feb. 23, 2006

(30) Foreign Application Priority Data

Jul. 5, 2002 (DE) ..... 102 30 394

(51) Int. Cl.
*F28D 1/02* (2006.01)

(52) U.S. Cl. ..... 165/176; 165/153

(58) Field of Classification Search ..... 165/173–176, 165/151–153

See application file for complete search history.

(56) References Cited

U.S. PATENT DOCUMENTS

| | | | | |
|---|---|---|---|---|
| 4,815,535 | A * | 3/1989 | Hagemeister | 165/173 |
| 5,190,101 | A * | 3/1993 | Jalilevand et al. | 165/176 |
| 5,492,172 | A * | 2/1996 | Laveran et al. | 165/173 |
| 5,761,808 | A * | 6/1998 | Patel et al. | 29/890.052 |
| 5,904,206 | A | 5/1999 | Kroetsch | |
| 6,216,777 | B1 * | 4/2001 | Rhodes et al. | 165/176 |
| 6,260,271 | B1 * | 7/2001 | Hayashi | 29/890.035 |
| 6,315,036 | B1 * | 11/2001 | Pogue et al. | 165/173 |
| 2002/0066553 | A1 * | 6/2002 | Fischer et al. | 165/174 |

FOREIGN PATENT DOCUMENTS

| | | |
|---|---|---|
| DE | 198 26 881 A 1 | 12/1999 |
| DE | 100 56 074 A 1 | 5/2002 |
| DE | 101 32 485 A 1 | 1/2003 |
| EP | 0 840 083 A2 | 5/1998 |
| EP | 0 840 083 A3 | 5/1998 |
| WO | WO 02/079708 A2 | 10/2002 |

* cited by examiner

*Primary Examiner*—Teresa J. Walberg

(74) *Attorney, Agent, or Firm*—Greer, Burns & Crain, Ltd

(57) ABSTRACT

A device is provided for heat transfer and in particular an evaporator for an air conditioning system of motor vehicles having at least one header tank including at least two header chambers which are substantially defined by a base device and a top device. The top device includes middle side walls which are arranged adjacent to one another at least over a portion. The distance between the two side walls increases with the height above the base device.

23 Claims, 7 Drawing Sheets

HEAT EXCHANGER IN PARTICULAR AN EVAPORATOR FOR A VEHICLE AIR-CONDITIONING UNIT

BACKGROUND

The invention relates to a device for heat transfer and in particular an evaporator in particular for air conditioning systems of motor vehicles having at least one header tank comprising at least two header chambers. Although the invention will be described below with reference to the evaporator of an air conditioning system of a motor vehicle, reference is made to that a limitation to such use is not intended but use in other air conditioners and the like is also included.

Such heat exchanger devices as mentioned above have been known in the prior art. DE 198 26 881 A1 discloses a heat exchanger having a header tank made of sheet metal formed from a pretreated plate. The header tank is divided into two chambers in the longitudinal direction wherein the ends of two rows of flat tubes arranged in-line are inserted into the base section or plate of the header tank through which the air to be cooled flows. The header chambers comprise side walls wherein the adjacent side walls of the two header chambers are in parallel and directly bordering each other and are brazed to one another and to the base to ensure tight sealing of the header tank.

DE 100 56 074 A1 discloses a heat exchanger where, contrary to other known devices, the connecting flanges are not mounted to the end faces of the header tank but to a longitudinal side such that a simple construction is achieved without additional components. In such a heat exchanger the adjacent side wall surfaces of the two chambers are also mounted in parallel and brazed to one another and to the header tank.

A drawback of the prior art heat exchangers is that manufacturing tolerances must be fairly narrow so as to minimize rejects.

It is therefore the object of the present invention to provide a heat exchanger which allows larger manufacturing tolerances.

SUMMARY

The heat exchanger of the present invention can in particular be employed as an evaporator in an air conditioning system of a motor vehicle. The heat exchanger comprises at least one header tank having at least two header chambers wherein substantially each header chamber is defined by a base device and a top device. The top device of a first header chamber comprises a first middle side wall and the top device of the second header chamber comprises a second middle side wall.

At least a section of the first middle side wall is positioned adjacent to the second middle side wall.

A lateral distance from the first middle side wall to the second middle side wall increases with the height above the base device at least over a portion of the height of the header tank.

The heat exchanger of the invention has numerous advantages.

Due to the header tank comprising at least two header chambers mounted side-by-side at least over a portion, a double-row evaporator can be provided wherein the air passing through the evaporator first passes a first row of flat tubes and then a second row of flat tubes.

Each header chamber is defined by the base device and a top device wherein the term "top device" is understood to mean the end of the header chamber above the base device. The top device may comprise one or two side walls and one cover wall or else a wall curved throughout (e.g. semicircular) or the like.

Due to the header chambers being positioned side-by-side and the lateral distance between the "middle" side walls, i.e. the side wall on the right of the left-hand header chamber and the side wall on the left of the right-hand header chamber, becoming wider apart farther away from the base device, a gap is obtained that is wider at a distance from said base device.

This ensures better flux conveyance and consequently enhanced utilizing of the braze material in the gap, thus also at the middle side walls and the base device when brazing the header tank.

The "middle" side walls are understood to mean adjacent side walls (also "contact side walls" because they are in complete or partial contact with each other) of the first and the second header chamber. Consequently the outer side walls in a dual-chamber header tank are the side walls at the outside, i.e. those side walls not bordering a header chamber. In a header tank comprising three header chambers, both side walls of the middle header chambers are so-called "middle" side walls since both are adjacent to another header chamber.

A gap tapering towards the base device will have a positive influence, in particular when heated, on flux conveyance toward and into the base device during brazing. With conventional i.e. parallel side walls, they must be precisely equidistant since the distance has an influence on capillary action.

The heat exchanger of the invention allows less critical manufacturing tolerances since the gap width changes continuously over the height and thus even imprecise manufacturing tolerances will result in a gap width at a suitable distance for good capillary action.

The favorable manufacturing tolerances allow both to keep the manufacturing costs low and to obtain low reject rates. Depending on the relation of precision of manufacturing tolerances versus manufacturing costs, the reject rate may be set low, or the reject rate may be somewhat higher than a viable minimum, wherein the manufacturing costs will be reduced on the whole due to the favorable manufacturing tolerances.

A preferred embodiment of the invention provides for the lateral gap between the first and the second middle side walls or the contact side walls to be substantially V-shaped. A continuous and strictly monotonically increasing distance is advantageous since this will always result in a suitable lateral distance substantially independent of manufacturing tolerances.

In another preferred embodiment of the invention, at least one stabilizing or distributing device is mounted at least to one side wall. A stabilizing device increases the structural stability. A distributing or stabilizing device may be provided at a middle or an outer side wall.

It is also conceivable to have one or more distributing or stabilizing devices mounted to one or both middle side walls and/or to one or more outer side walls. The distributing or stabilizing devices may be provided inside the header chambers and/or in a space external thereof or extending internally and externally of the header chambers.

A longitudinal direction at least at one distributing or stabilizing device is preferably arranged substantially perpendicular to the base device such that the distributing or stabilizing devices preferably extend substantially approximately perpendicular to the base device surface.

In a preferred embodiment at least one distributing or stabilizing device is configured as a depression system which may be shaped as a groove system or a notch or the like.

It is conceivable that the depression system is a depression in the outer surface of a side wall of a header chamber extending for example upwardly from the base device to a specified height above the base device. The depression system may for example be configured V-shaped or U-shaped wherein the width of the U, i.e. the width between the flanges, may be significantly larger than the depth of the U.

Possible ratios of depression width to depression depth range from 1:10 to 100:1, wherein the range between approximately 1:5 and 80:1 is preferred. For notch-type depression systems a ratio in the range of 1:1 is preferred while considerably higher values are possible in particular with groove-type depression systems.

Depression systems or stabilizing systems in general, manufactured in particular but not exclusively in non-cutting processes increase the lateral stability of the side walls and thus of the header chambers as a whole.

Distribution devices facilitate distribution of the flux and the braze material.

This enhances the manufacturing process still further since manufacturing tolerances may be improved while the reject rate remains the same or even decreases.

Depression systems at the outer surfaces of the middle side walls or the contact walls are advantageous since they ensure that between the side walls or the flanges of the header chambers capillary gaps are formed which may also cover a large area depending on the width of the depression system. Such capillary gaps, both narrow and wide, favor the flux conveyance in brazing so as to achieve a reliable brazed joint of the side walls to one another and to the base device.

In typical flat-tube type evaporators for air conditioning systems of motor vehicles the height of the depressions may be between approximately 0.05 and 0.4 mm, wherein the width may be in the range of 0.05 mm to 8 or 10 mm or still more. Reference is made to that the values indicated refer only to one concrete example. This and other flat-tube type evaporators or evaporators in general allow both smaller and larger dimensions.

In another preferred embodiment of the invention at least one distribution device or at least one stabilizing device protrudes outwardly wherein preferably at least one distributing or stabilizing device projects outwardly from one side wall of at least one header chamber. It is particularly preferred that at least one stabilizing device projects outwardly from one of the middle side walls or contact side walls such that the lateral distance (or gap) between the two middle side walls is reduced at the location of a stabilizing device.

It is preferred that at least one distributing or stabilizing device is configured as a crease system which is particularly preferably manufactured in a non-cutting process.

It is particularly preferred to provide a plurality of distributing or stabilizing devices preferably equidistant at least over a portion or also over the entire length of at least one header chamber wherein the stabilizing devices may be positioned alternating on the outwardly directed surfaces of the middle side wall of the first header chamber and the middle side wall of the second header chamber. It is likewise conceivable to provide all of the stabilizing devices only on one middle side wall or on one header chamber.

In a preferred embodiment of the invention, a depth of a distributing or stabilizing device increases with increasing distance from the base device. For example, the depth, i.e. the perpendicular distance of the outer dimension of the stabilizing device relative the side wall, may be one third of the maximum depth near the base device. In stabilizing devices protruding outwardly this will be the height relative the side wall, while in depression systems serving as stabilizing devices it is understood to be the depth of the depression relative the side wall.

In a preferred embodiment of the invention a depression in the base device is provided in a contact region of the middle side walls with the base device wherein said depression may for example be configured as a groove to serve as a guide for the side wall ends.

In another preferred embodiment of the invention at least one flat tube is less in wall thickness in the region of a flank than in a region of the curvature or the radius.

This embodiment is very advantageous since the particular tube geometry of the flat tube having an increased radius allows to achieve high stability while maintaining low weight. This results in lightweight tubes and thus generally in a low entire weight. This is also an overall cost reduction.

Preferably the wall thickness of the flat tube in the region of the flanges is smaller by 10% or 20% than in a region of the radius.

Preferably the ratio of wall thickness in the region from thickness in the radius to thickness in the flange is in a range of approximately 1.2 to 3 and particularly preferred in the range of approximately 1.4 to 2.

One configuration of the invention may have a wall thickness of the flat tube in the region of the flanges at least at one location of approximately 0.2 to 0.4 and preferably 0.3 mm. In this configuration in particular the wall thickness of the flat tube in the region of the radius will then at least at one location be between 0.4 and 0.7 mm and preferably approximately 0.5 to 0.6 mm.

A reduction of the wall thickness in the region of the flanges results in considerable overall weight-saving in the flat tubes.

In a preferred embodiment of the invention at least one top device is manufactured integrally such that the middle and the outer side wall and the top cover wall are one piece.

In a preferred embodiment of the invention, at least one top device or two top devices are manufactured integrally with the base device. It will then be possible, using a header tank comprising two header devices, to manufacture from a pretreated plate, for example by bending, substantially the entire header tank as one-piece.

To accomplish a header tank subdivided into at least two chamber systems, the header tank can be configured integrally such that the side elements extending from the base element are bent towards the base element and finally joined together and to the base element.

For this purpose the side elements must be permanently joined, for example brazed, to one another and to the base elements. It has been known for example to configure the side elements such that they extend substantially perpendicular toward the base element such that their surfaces can be brazed to one another and to the base element.

The base device can be pretreated such that it has the desired dimensions or also the required apertures or depressions for connection with the side or top cover devices. Since the header tank can be given its final shape before the final brazing operation, the device will be very firm even before brazing.

In a preferred embodiment of the invention, at least one connection aperture of the heat transfer is mounted to a longitudinal side section of the header tank wherein it is also conceivable to position a connection aperture at an end face of a header tank or that both connection apertures are provided at the end faces or at one or both longitudinal sides of the header tank.

In a preferred embodiment of the invention, the header tank is connected with two rows of heat-exchange tubes arranged in-line. It is likewise conceivable to connect three or more rows of heat transfer tubes with the header tank. Although it is preferred to provide a header chamber for each row of heat transfer tubes, it is also conceivable to provide one header chamber each for example for two (or three or more) rows of heat transfer tubes.

In a preferred embodiment at least one side wall is provided with at least one tab device or the like for insertion into recesses of the base devices. The insertion point may be caulked. The caulk point may also be punched into the guiding crease after shaping the header. Caulking the insertion point before brazing offers the advantage of a firm connection of the parts to be brazed.

It is preferred to mount a cover lid at least to one, preferably to both end faces of the header chambers.

It is further preferred to provide a guiding crease for the partition so the partition can substantially not tilt and jam and it is in better contact with the header due to the U-shaped frame. U-shaped frames or creases in the region of the contact surfaces of the side walls or flanges will also result in larger brazing surfaces.

A combination for example of a V-shaped gap between the inner side walls of the two header chambers with other distributing or stabilizing devices such as protruding creases or depressions allows to provide a larger tolerance zone such that in a concrete example the gap distance at the open end of the V-gap may vary by up to 50%, being in a range between 0.15 and 0.23 mm while at the lower end at the base device it is between 0.05 and 0.11 mm.

The stabilizing devices ensure that there will always be a sufficient capillary gap for flux conveyance, independent of manufacturing deviations in shape.

To narrow or too wide gaps in conventional heat exchangers inhibit flux conveyance in particular during heating such that close manufacturing tolerances must be kept or a large number of rejects is accepted.

BRIEF DESCRIPTION OF THE DRAWINGS

Further advantages and uses of the invention will now be described with reference to the drawings.

DETAILED DESCRIPTION OF THE PREFERRED EMBODIMENTS

A first embodiment of the heat exchanger of the invention configured as an evaporator for an air conditioning system of motor vehicles will now be illustrated with reference to the FIGS. 1 to 7.

Figure 1:
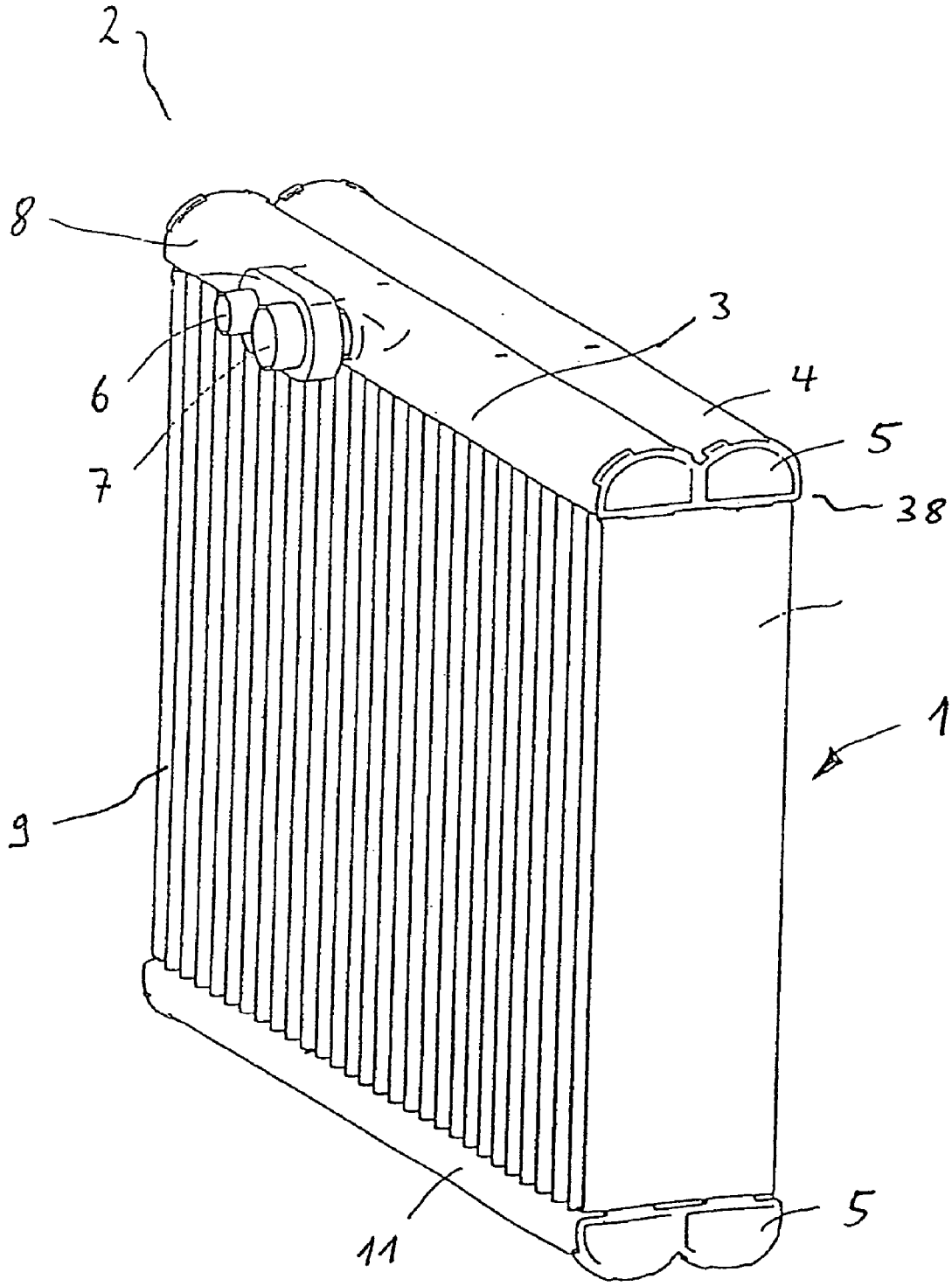
FIG. 1 is a perspective view of a heat exchanger of the invention in a first preferred embodiment.

The heat exchanger shown in perspective in FIG. 1 comprises an upper header tank 2, a lower header tank 11 with heat transfer tubes 9 positioned inbetween.

The upper header tank 2 comprises a first header chamber 3 and a second header chamber 4 parallel thereto whose end faces are closed by cover lids 5. An inlet 6 and an outlet 7 for the evaporating coolant is provided at one longitudinal side 8 of the first header chamber 3.

It is pointed out, however, that inlet 6 and outlet 7 may be provided not only at a longitudinal side 8 of one or both header chamber(s) 3 of the header tank 2 but it is also possible to provide the inlet at a longitudinal side of the first header chamber 3 and the outlet at a longitudinal side of the second header chamber 4.

Figure 11:
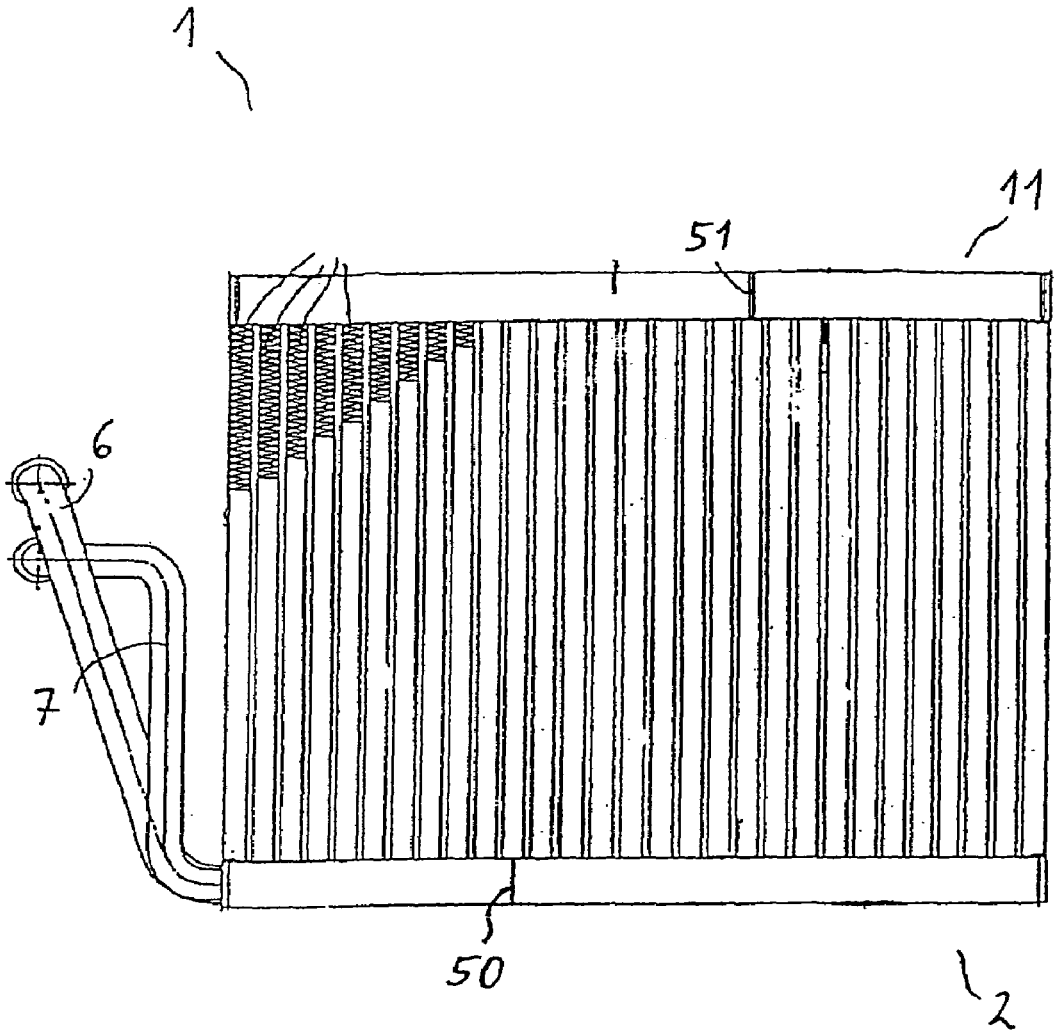
FIG. 11 is a side view of another embodiment of the heat exchanger of the invention.

It is also conceivable to provide the inlet and the outlet at the end faces of one or both header chambers as illustrated in the embodiment of FIG. 11 where inlet and outlet are provided at the end faces of the two header chambers of the header tank.

Figure 2:
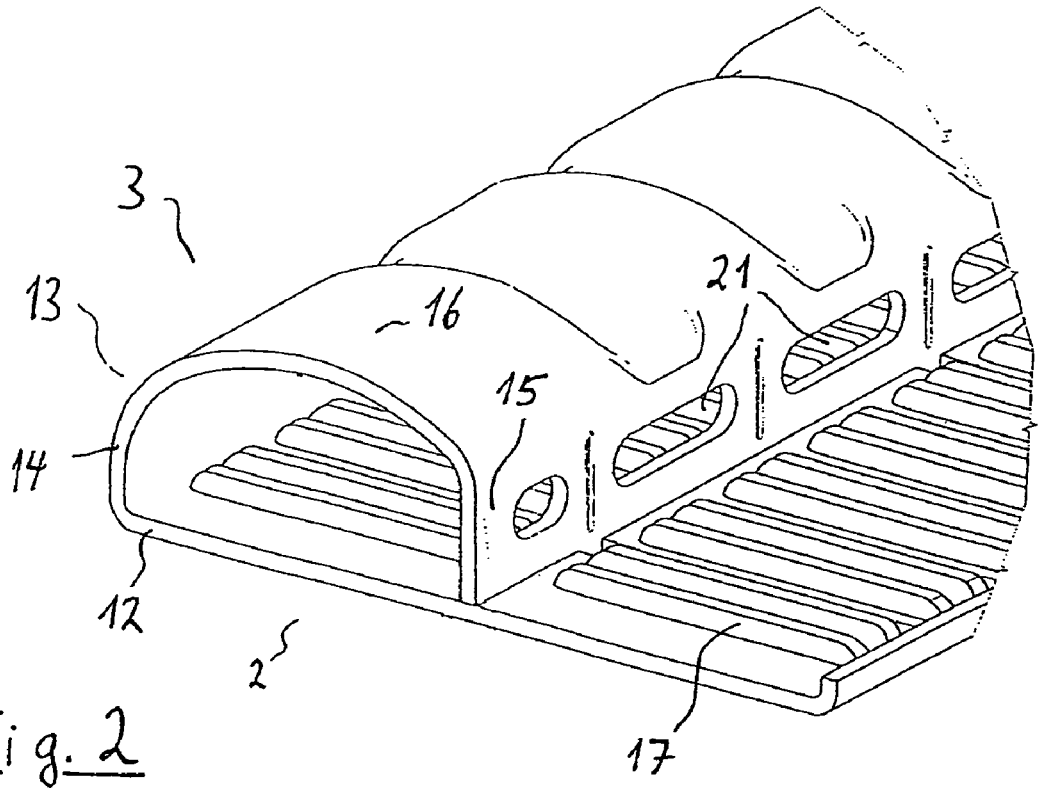
FIG. 2 is a partial view of the header tank from the embodiment in FIG. 1.

FIG. 2 is an enlarged illustration in detail of the base 12 of the header tank 2 and a top element 13 of the first header chamber 3.

The top element 13 of the first header chamber 3 in the present embodiment is manufactured integrally with the base 12 of the header tank. The second top element 23 may also be manufactured integrally with the base 12.

The top element 13 of the first header chamber 3 comprises, an outer side wall 14, a top wall 16 and a middle side wall 15 which is mounted approximately in the center of the header tank 2 in the present embodiment.

The lateral edge region of the base 12 is bent over to form the top element 13 including the outer side wall 14, the middle side wall 15 and the upper side wall 16 with a continuous transition between the individual wall regions. The "middle" side wall 15 in the middle of the base 12 is formed by the end of the integral component.

Figure 3:
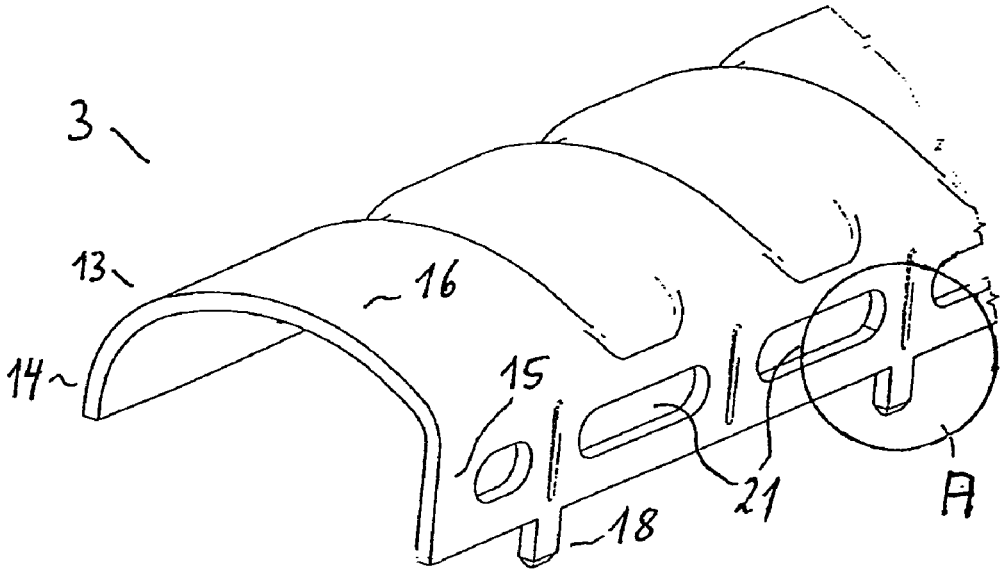
FIG. 3 is a partial view of a top element of the header tank in FIG. 2.
Figure 5:
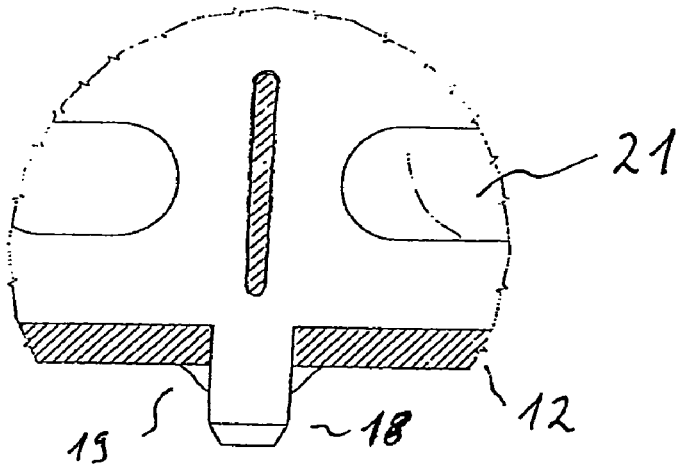
FIG. 5 is detail A from FIG. 2.

As can be seen in FIG. 3, the edge of the middle side wall 15 has tabs 18 protruding from the edge of the middle side wall 15 to be inserted in matching recesses 19 in the base region of the header tank during manufacture. The tabs 18 are preferably caulked with the base 12 to achieve a tight fit of the top element 13 and the middle side wall 15 in the base element 12. Firm and permanent braze joints between the individual elements are thus ensured because the elements cannot move relative one another during brazing. FIG. 5 is an enlarged illustration thereof.

The base 12 of the header tank 2 is equipped with tube receptacles 17 for connecting the flat tubes 9.

In an end region of the first header chamber 3 and the second header chamber 4 the middle side walls 15 and 25 are provided with overflow apertures 21 to allow overflow of the refrigerant from the first header chamber 3 into the second header chamber 4 or, depending on the configuration, in reverse direction.

Figure 4:
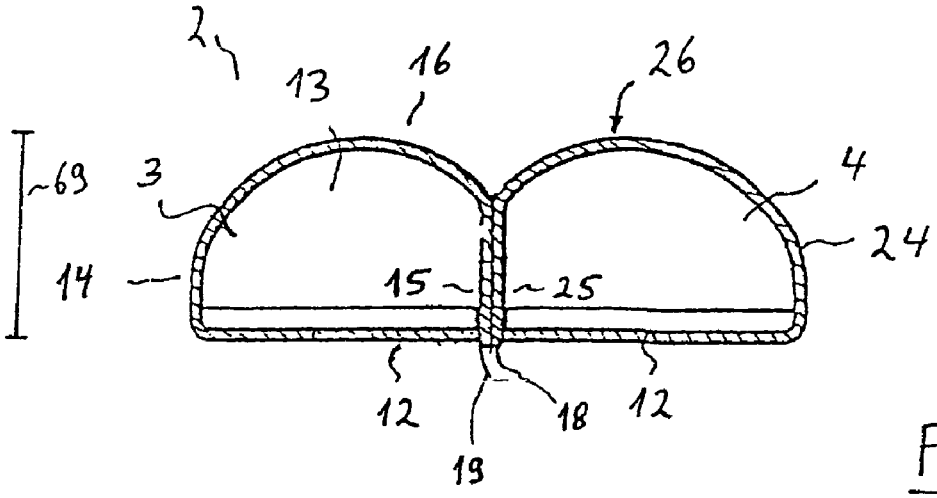
FIG. 4 is a sectional view of the header tank in FIG. 1.

FIG. 4 is a sectional side view of the header tank 2 where tabs 18 are inserted in recesses 19 in the contact region of the middle side walls 15 and 25 with the base 12 where they are caulked to facilitate brazing. The header tank 2 has an overall height 69.

Figure 6:
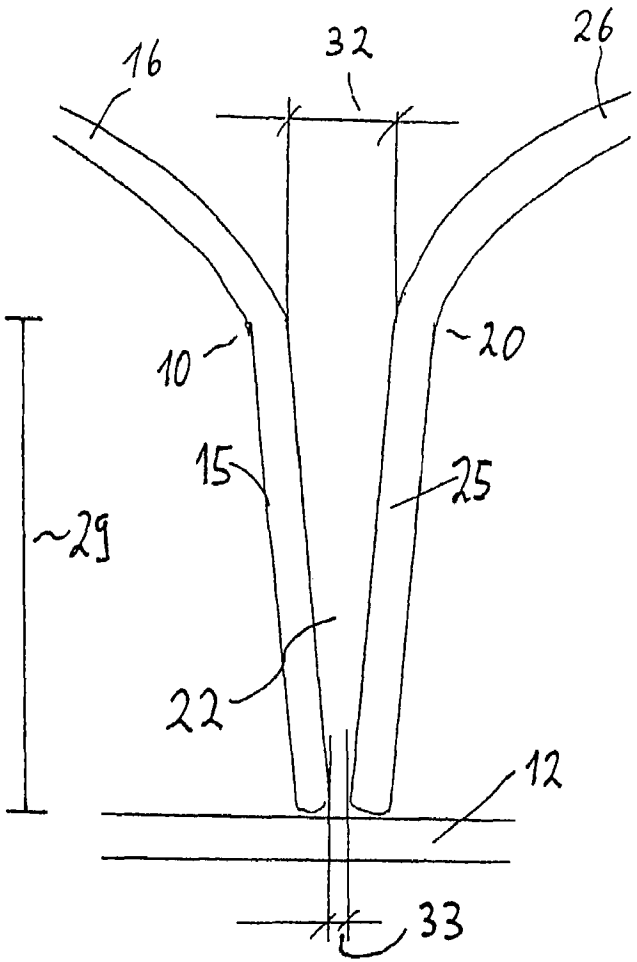
FIG. 6 is a schematic side view of a portion of the header tank of the heat exchanger in FIG. 1.

FIG. 6 is a schematic side view, not true to scale, of the contact region of the middle side wall 15 and the middle side wall 25 with the base 12 of the header tank 2. While a lateral distance 33 is provided at the contact point with the base 12, there is a lateral distance 32 between the middle side walls at a height 29 above the base 12.

In the embodiment, a distance of 0.1 mm is provided at 33 and at a height 29 of approximately 10 mm, the distance 32 is approximately 0.3 mm such that the aperture angle between the middle walls 15 and 25 is about 1°. The V-shaped gap 22 allows reliable capillary action in brazing.

At the height 29 above the base device 12 a knee 10 is provided in the first header chamber 3 and a knee 20 in the second header chamber 4 as can also be taken from the not schematic FIG. 4. While the outer side walls 14 and 24 blend imperceptibly into top cover walls 16 and 26, the middle side walls 15 and 25 are clearly offset against the cover walls 16 and 26 at the knees 10 and 20.

Figure 7:
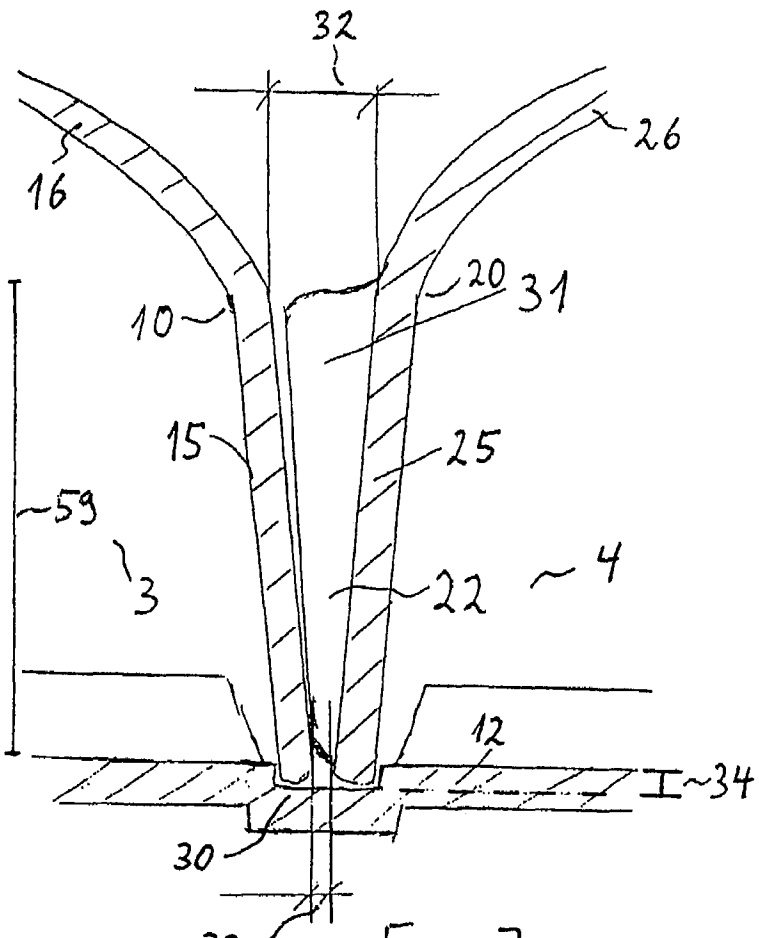
FIG. 7 is a schematic illustration of a second embodiment of a header tank.

FIG. 7 illustrates another embodiment of a header tank 2 where like parts have like reference numerals. This header tank 2 also comprises a first header chamber 3 and a second header chamber 4 comprising middle side walls 15 and 25, respectively.

In this embodiment the V-shaped gap 22 has a crease 31 or a number of creases 31 arranged at regular intervals over the length of the header tank 2.

The individual creases 31 may for example only be provided at the outside of the middle side wall 25; preferably, however, alternating on the outside of the middle wall 15 and the middle wall 25. Due to manufacturing conditions, the creases may also be provided only at one outside wall of a middle side wall (15 or 25).

The outer shape of the crease 31 is substantially also a V such that near the base 12 its depth, i.e. its distance from the outside of the wall is smaller than the distance 29 in the upper region at the height of the knee 20. The dimensions of the crease 31 are designed to be adapted to the gap 22 such that near the base the depth is approximately 0.1 mm and at the height 29 above the base 12 approximately 0.3 mm. The height 59 of the crease may, but not necessarily, coincide with the height 29 of the knees 10, 20.

Other dimensions are, however, also conceivable so that the values indicated are intended to be merely exemplary. It is in particular conceivable that the dimensions of the crease are smaller by a certain percentage than the dimensions 32 or 33 which define the predetermined distance of the side walls 15 and 25. The creases will thus guarantee a minimum distance.

In addition to the embodiment in FIGS. 1 to 6, the embodiment in FIG. 7 provides, in the contact region of the side walls 15 and 25 with the base 12, a recess 30 having a depth 34, in the present embodiment 0.1 mm. The recess 30 facilitates manufacture of the header tank 2 since the edges of the side walls 15 and 25 are guided in the recess 30 prior to brazing and thus are laterally secured.

The creases 31 form large-area capillary gaps which allow even distribution of the flux and the braze material. The creases 31 further fulfill the function of a spacer between the outsides of the middle side walls 15 and 25. It is reliably guaranteed that the distance is not too narrow to ensure a reliable brazed joint.

Figure 9:
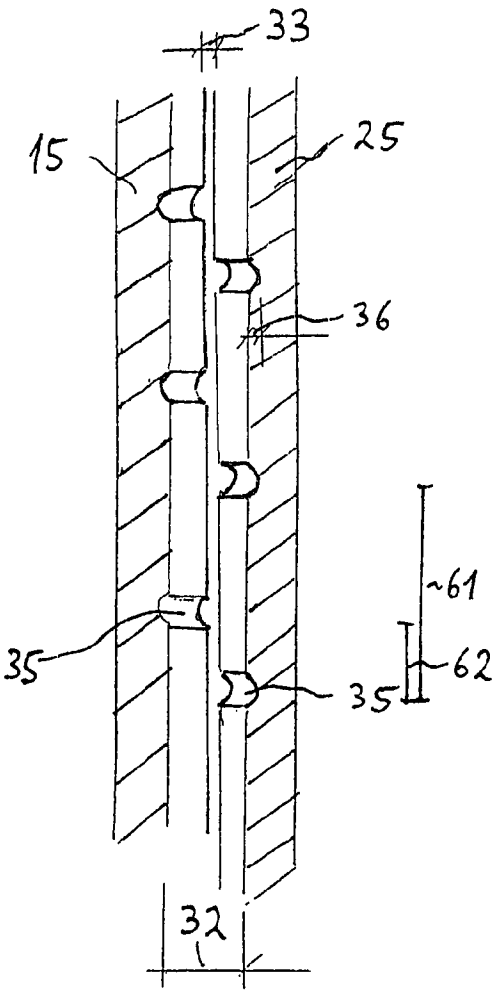
FIG. 9 is a portion of a sectional top view A-A of the header tank of FIG. 8.
Figure 8:
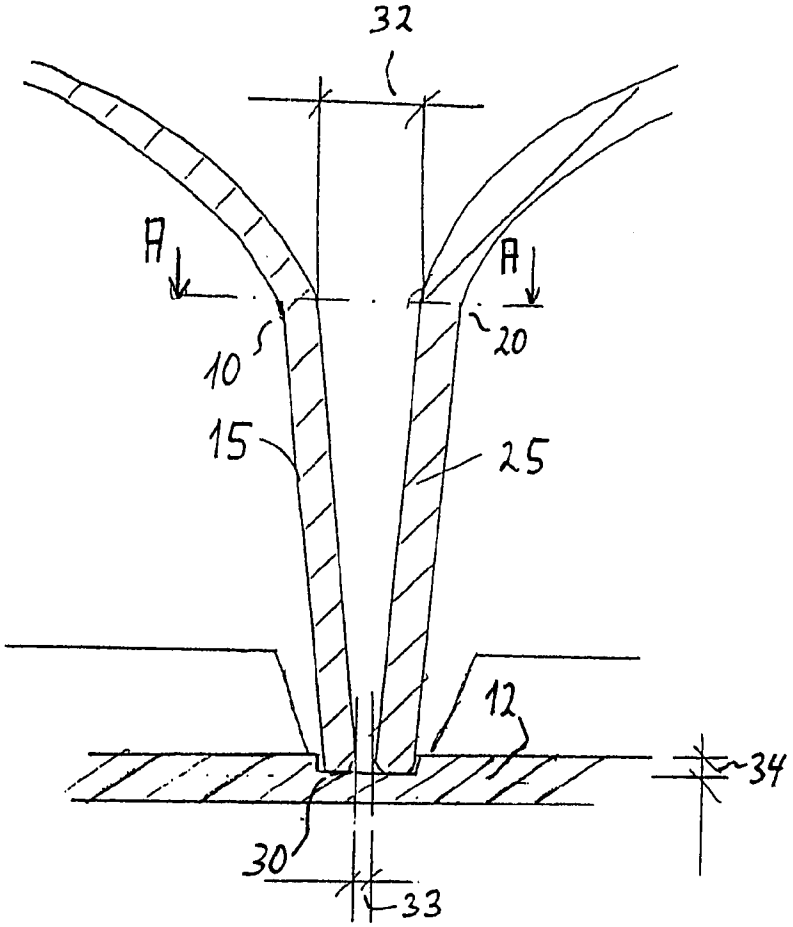
FIG. 8 is a schematic side view of a third embodiment of a header tank of a heat exchanger.

The embodiment of FIGS. 8 and 9 provides stabilizing devices in the form of grooves 35. The grooves 35 have a depth 36 which is 0.1 mm in this embodiment. In analogy to the embodiment having the creases 31 as in FIG. 7, the embodiment having groove-type depressions 35 as in the FIGS. 8 and 9 may also provide that the depth of the grooves varies with the distance from the base 12 of the header tank.

In this embodiment, the surface profile generated by the grooves 35 gives stability to the top element(s) 13 and 23 of the two header chambers 3, 4.

The grooves 35 fulfill the function of distributing flux and braze material to allow secure joining of the side walls 15 and 25 to the base 12.

As in the previous embodiment, there is also provided a recess 30 in the contact region of the middle side walls 15 and 25 with the base 12.

FIG. 9 is a sectional top view A-A from FIG. 8.

The groove-type recesses 35 can be recognized in a top view in FIG. 9. In this embodiment the groove-type recesses 35 are provided on both middle side walls 15 and 25.

In this embodiment the grooves are generated by upsetting the material during shaping by bending so as to result in the recesses illustrated at each outside of the middle side surfaces.

A plurality of recesses is provided which in this case have even distances 61 from one another also at the middle side walls. The recesses in the side wall 15 are displaced relative the recesses in the side wall 25 by a dimension 62 which preferably corresponds to half the distance 61.

In the embodiment of the FIGS. 8 and 9 the distance 33 between the side walls in the contact region of the side walls with the base is about one third of the distance at the height 29 of the knees 10 and 20.

Figure 10:
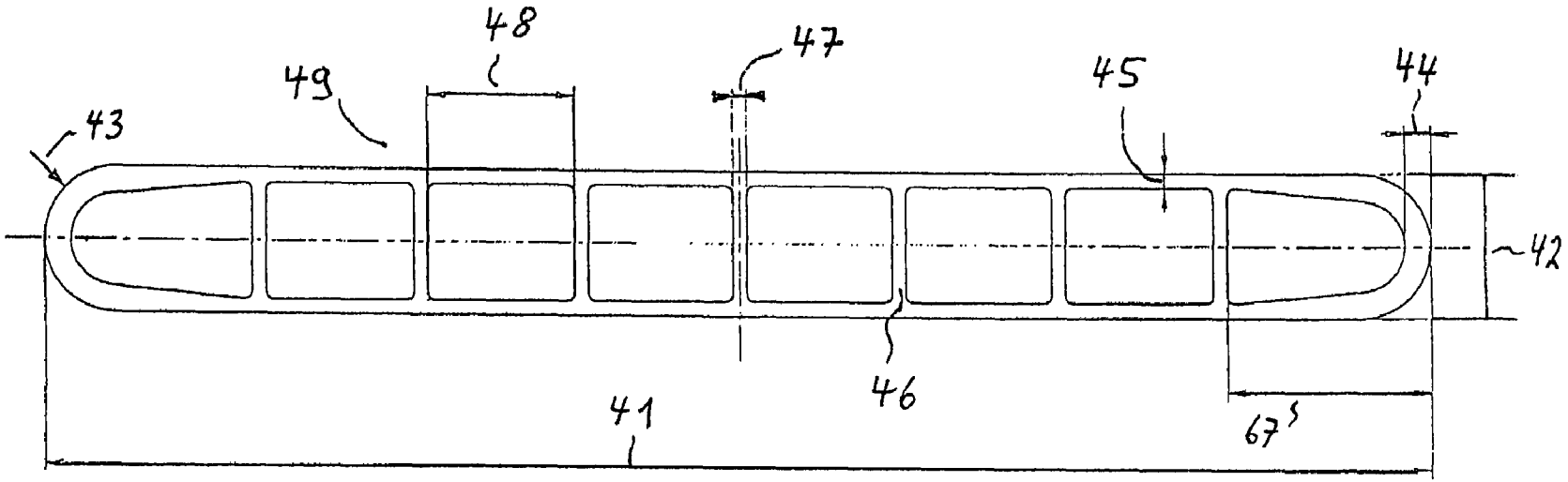
FIG. 10 is a sectional view of a flat tube of the invention.

FIG. 10 shows a flat tube 40 for a heat exchanger of one of the embodiments.

The outer dimensions of the flat tube perpendicular to the flow direction of a refrigerant are, a length 41 of 30 mm and a width 42 of 3 mm. Other dimensions are also conceivable. In the region of the radius or the roundings 43 the wall has a thickness 44 of 0.55 mm while in the flange region 49 the wall thickness 45 is 0.3 mm, thus significantly thinner.

The flat tube is divided over the width into 8 fluid passages, where the six middle ones have an inner width of 3.2 mm. The partitions 46 have a width 47 of 0.3 mm.

The significantly different wall thicknesses in the radius region and the flange region result overall in a considerably lower total weight of the flat tube since in the region of the radius 43 the wall is relatively thick while in the region of the flanges, thick walls are not required.

FIG. 11 is a side view of a heat exchanger 60 which also comprises header tanks 2 and 11.

Partitions 50 and 51 divide the header tanks 2 and 11 into a number of longitudinal sections so as to result in a meander-type flow path of the evaporation medium through the heat exchanger 60.

This embodiment provides the connections 6 and 7 for inlet and outlet at the end faces of the header tank 2 at the header chambers 3 and 4.

With respect to the further configuration of the heat exchanger and in particular the configuration of the flow conditions in the header tank and the remainder of the heat exchanger, reference is made to DE 198 26 881 A1 to the present applicant and in particular to column 1, line 1, to column 6, line 16 in conjunction with the FIGS. 1 to 6, the disclosure of which is incorporated by reference.

Further particulars of the heat exchanger may also be realized as in DE 100 56 074 A1 US Published Application No. 2002/0066553 A1 to the present applicant as is described there in column 1, line 1, to column 8, line 22 with reference to the FIGS. 1 to 5, the contents of which are incorporated by reference.

The invention claimed is:

1. A heat exchanger, in particular an evaporator for an air conditioning system of motor vehicles, comprising:

at least one header tank having at least two header chambers wherein substantially each header chamber is substantially defined by a base device and a top device;

wherein the top device of a first header chamber comprises a first middle side wall and the top device of a second header chamber comprises a second middle side wall;

wherein at least a section of the first middle side wall is positioned adjacent to the second middle side wall;

wherein a lateral distance of the first middle side wall from the second middle side wall increases with the distance from the base device at least over a portion of the height of the header tank; and wherein opposing portions of the first and second middle side walls are planar such that the lateral distance between the first and second middle wall is a V-shaped gap which is continuous and strictly monotonically increasing.

2. The heat exchanger of claim 1, characterized in that at least one stabilizing device is provided on at least one side wall to increase stability.

3. The heat exchanger of claim 2, characterized in that a longitudinal direction of at least one stabilizing device is substantially perpendicular to the base device.

4. The heat exchanger of claim 2, wherein at least one stabilizing device is configured as a depression system.

5. The heat exchanger of claim 2, wherein at least one stabilizing device is configured as a groove system.

6. The heat exchanger of claim 2, wherein at least one stabilizing device is substantially configured as a groove.

7. The heat exchanger of claim 2, wherein at least one stabilizing device projects outwardly.

8. The heat exchanger of claim 7, characterized in that at least one stabilizing device is configured as a crease system.

9. The heat exchanger of claim 2, wherein a depth of at least one stabilizing device increases with a distance from the base device.

10. The heat exchanger of claim 1, wherein at least one partition is provided which comprises a guiding crease.

11. The heat exchanger of claim 1, wherein in a contact region of the middle side walls with the base device a base recess is positioned.

12. The heat exchanger of claim 1, wherein at least one flat tube has a smaller wall thickness in the region of a flange than in a region of a radius.

13. The heat exchanger of claim 12, characterized in that at least one flat tube has a wall thickness in the region of the flanges smaller by at least 20% than in a region of the radius.

14. The heat exchanger of claim 12, wherein at least one flat tube has a wall thickness of approximately 0.3 mm at least at one position in the region of the flanges.

15. The heat exchanger of claim 12, wherein at least one flat tube has a wall thickness of approximately 0.5 mm at least at one position in the region of a radius.

16. The heat exchanger of claim 1, wherein at least one top device is manufactured integrally.

17. The heat exchanger of claim 1, wherein at least one top device is manufactured integrally with the base device.

18. The heat exchanger of claim 1, wherein at least one connection aperture is arranged on a longitudinal side section of the header tank.

19. The heat exchanger of claim 1, wherein the header tank is connected with two rows of heat exchanger tubes arranged in-line.

20. The heat exchanger of claim 1, wherein the base device and/or the top device are formed of a pretreated plate.

21. The heat exchanger of claim 1, wherein at least one side wall comprises at least one tab which is inserted in a recess of the base device.

22. The heat exchanger of claim 1, wherein a cover lid is arranged at least at one end face of at least one header chamber.

23. The heat exchanger of claim 1, wherein at least one connection aperture is arranged at one end face of at least one header chamber of the header tank.

* * * * *